US006953298B2

(12) United States Patent
Healy

(10) Patent No.: US 6,953,298 B2
(45) Date of Patent: Oct. 11, 2005

(54) PINSTRIPE PAINTING DEVICE

(75) Inventor: Daniel Healy, Dania Beach, FL (US)

(73) Assignee: Z-Stripe Licensing Corp., Lakeland, FL (US)

( * ) Notice: Subject to any disclaimer, the term of this patent is extended or adjusted under 35 U.S.C. 154(b) by 138 days.

(21) Appl. No.: 10/644,674

(22) Filed: Aug. 20, 2003

(65) Prior Publication Data

US 2005/0042016 A1 Feb. 24, 2005

(51) Int. Cl.[7] ..... B43K 29/00; A46B 11/00; B05C 17/00

(52) U.S. Cl. ..... 401/193; 401/48; 401/208; 118/207

(58) Field of Search ..... 401/48, 193, 208, 401/218, 219, 220; 118/207, 208

(56) References Cited

U.S. PATENT DOCUMENTS 1,830,860 A * 11/1931 Scoles ..... 401/218
1,988,710 A * 1/1935 Beugler ..... 401/208
2,582,861 A * 1/1952 Coombs ..... 401/208
2,721,347 A * 10/1955 Benkowski ..... 401/219
3,448,722 A * 6/1969 Krizman ..... 118/207
6,789,974 B2 * 9/2004 Atkinson et al. ..... 401/208

* cited by examiner

*Primary Examiner*—David J. Walczak
(74) *Attorney, Agent, or Firm*—Robert M. Downey, PA

(57) ABSTRACT

A device for applying a painted pinstripe to a surface includes a paint applicator having an adaptor for attaching a paint striping wheel head to a low profile paint container. A traveler adjustably coupled to the applicator is moveable along a magnetized flexible guide track in order to control direction of the paint applicator as an annular paint carrying surface of the striping wheel is rolled against the surface being pinstriped. The paint applicator is adjustably positionable on a connecting arm extending from the traveler for controlling and adjusting the distance of the striping wheel relative to the guide track. The paint applicator is also pivotally adjustable relative to the connecting arm and the guide track to accommodate for variations in surface configuration and contour so that the annular surface of the striping wheel is maintained in flat contact with the work surface to produce a uniform painted pinstripe.

1 Claim, 3 Drawing Sheets

PINSTRIPE PAINTING DEVICE

BACKGROUND OF THE INVENTION

1. Field of the Invention

This invention relates generally to the field of pinstripe painting and, more particularly, to a pinstripe painting device which uses a traveler and flexible magnetic guide track to direct a striping wheel along a predetermined path, and wherein the device includes means for adjustably positioning the striping wheel relative to the guide track.

2. Discussion of the Related Art

The application of a painted stripe to a surface, such as the exterior of an automobile body, is most commonly done with a device that uses a rotating striping wheel. In operation, paint is first carried on the outer annular surface of the striping wheel and then, as the annular surface contacts the surface being striped, the paint is released from the annular surface of the striping wheel to produce a stripe on the work surface. The thickness of the wheel (i.e. the width of the annular surface) determines the pinstripe thickness. In order to maintain a uniform thickness of the painted stripe along its entire length, it is essential to maintain the annular surface of the striping wheel in flat, uniform contact with the surface being pinstriped. A partial or full separation of the annular surface of the striping wheel from the work surface will result in a non-uniform, and sometimes broken stripe. However, maintaining the annular surface of the striping wheel in flat, uniform contact with the work surface can be difficult, particularly when encountering variations in surface angle, configuration and contour, as well as obstructions such as side view mirrors and door handles along the sides of an automobile body.

Pinstripe painting devices of various construction and operation are well known in the art. Of particular relevance to the present invention is the device disclosed in U.S. Pat. No. 3,448,722 to Krizman directed to a painting guide useful for providing pinstripes on automobiles. The Krizman device includes a magnetic strip with a track which guides a roller for application of the painted stripe to the surface. The magnetic strip can be attached to the surface being painted and is flexible to conform with the configuration of the surface. The magnetic strip is sufficiently flexible to insure that the guide can be adjusted to provide a straight or curved pinstripe, as desired.

U.S. Pat. No. 1,988,710, to Beugler, discloses a paint striper device having a barrel or tube adapted to contain paint and a head attached to the end of the barrel and including a striping wheel. In operation of this device, the paint is filled in the barrel and the wheel is rotated in engagement with the surface to be striped. As the wheel rotates, paint is carried by capillary or viscosity action along the periphery of the wheel which applies the paint to the surface. The Beugler device uses a plunger which is forced inwardly, into the barrel, so that the paint is pushed towards the end of the barrel and into communication with the head and rotating striping wheel. The user of this device must carefully try to maintain a flat contact of the striping wheel with the surface, while dragging the striping wheel in a straight line, or other path, without the use of a guide track, and simultaneously forcing the plunger into the barrel. The Beugler device does not allow for pivotal adjustment in order to accommodate for variations in surface angle, contour and/or configuration. Thus, it is extremely difficult to maintain the annular outer peripheral surface of the striping wheel in flat, uniform contact with the surface being pinstriped. This is most noticeable when using wider striping wheels, wherein a failure to maintain the annular surface of the striping wheel in flat contact with the surface being striped results in an obvious variation in stripe thickness and, accordingly, a non-uniform pinstripe. Additionally, the length of the barrel, which holds the paint, can present problems, particularly when trying to navigate past obstructions such as side view mirrors. Changing paint colors in the Beugler device is also quite involved and time consuming. Not surprisingly, most people in the field find this device to be extremely difficult and awkward to use.

The painting guide disclosed in Krizman, U.S. Pat. No. 3,448,722, and other similar devices which use a magnetic guide strip, overcomes many of the problems and difficulties associated with use of the Beugler device. Notwithstanding, the Krizman pinstripe painting device has several shortcomings which limit its usefulness in the field. Specifically, the Krizman device does not accommodate for angled or pivotally adjustable positioning of the paint head and striping wheel relative to the guide track in order to accommodate for variations in surface angle and configuration. Moreover, the rail on the track and the recessed area on the roller which engages the rail are both of a square configuration, thereby requiring the roller to be maintained perpendicular to the guide track. This further limits the ability to maintain a flat contact between the paint striping wheel and the surface being pinstriped, particularly when encountering variations in surface angle and configuration. A further problem encountered when using the Krizman device is the difficultly in overcoming obstructions in the striping path, such as door handles, manufacturers emblems or other obstructions in the path of the striping wheel. These obstructions may also prevent the magnetic guide track from lying flat on the automobile body surface. The inability of the Krizman device to pivot or adjust in a manner which allows the user to maintain the annular surface of the striping wheel in flat, uniform contact with the surface being pinstriped makes obstructions all the more troublesome. Moreover, the size of the paint container of the Krizman device presents problems when attempting to navigate around obstructions, such as side view mirrors.

Accordingly, there remains an urgent need in the pinstriping art for an improved pinstripe painting device which overcomes the numerous shortcomings associated with the devices known in the prior art, including those discussed above.

OBJECTS AND ADVANTAGES OF THE INVENTION

It is a primary object of the present invention to provide a pinstripe painting device for applying a painted stripe to a surface, such as the exterior surface of an automobile body, and wherein the device easily adapts to variations in surface contour, angle, and configuration.

It is a further object of the present invention to provide a pinstripe painting device which is easy to use, even by persons having little skill.

It is yet a further object of the present invention to provide a pinstripe painting device which uses a flexible, yet rigid magnetic guide track and an adjustable connecting arm between a traveler and paint applicator to accommodate for variations in surface angle, configuration and contour, as well as adjustments of the height or distance of the paint striping wheel relative to the guide track.

It is yet a further object of the present invention to provide a pinstripe painting device which allows for easy application of parallel painted stripes on a surface, such as the exterior surface of an automobile.

It is still a further objection of the present invention to provide a pistripe painting device which is extremely versatile and which allows even a person of minimal skill or training to apply a quality, uniform painted stripe to a surface of varying contour, angle and configuration after just a short period of time of using the device.

SUMMARY OF THE INVENTION

A device for painting pinstripes, such as on the exterior surface of an automobile, includes an applicator having an adaptor for attaching a head with a striping wheel to a low profile paint container. An outer annular surface of the striping wheel is adapted to carry paint, by viscosity action, as the striping wheel is rotated in communication with a charge of paint filled in the container. Rolling the annular surface of the striping wheel against the surface being pinstriped results in application of a painted stripe of uniform thickness. A traveler is provided with rollers which have a concave recessed annular surface for congruent engagement with a rail extending longitudinally along a flexible magnetic guide track. The flexible magnetic guide track is adapted for removable mounting on ferrous metal surfaces of varying configurations to conform to the desired stripe path along the surface. A connecting arm couples the paint applicator to the traveler and is adjustably positionable to control the distance between the striping wheel and the guide track. The paint applicator is further pivotally adjustable relative to the connecting arm and traveler to maintain the striping wheel in flat, uniform contact with the surface being striped, thereby accommodating for variations in surface configuration and contour and producing a uniform pinstripe. The recessed concave annular surface of the rollers and the congruent exterior surface of the rails on the guide track are recessed to permit lateral rocking movement of the traveler relative to the guide track, thereby further accommodating for changes in contour and surface angle so that the outer annular, paint application surface of the striping wheel maintains flat contact with the subject work surface throughout the length of the painted stripe.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
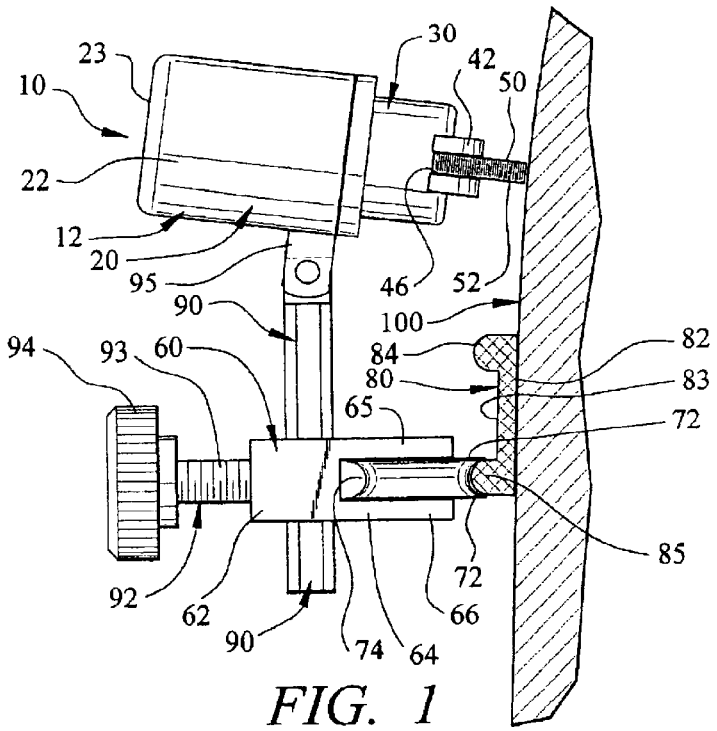
FIG. 1 is a side elevational view showing the pinstripe painting device in use to apply a painted stripe along a metallic surface, such as the side of an automobile body.
Figure 2:
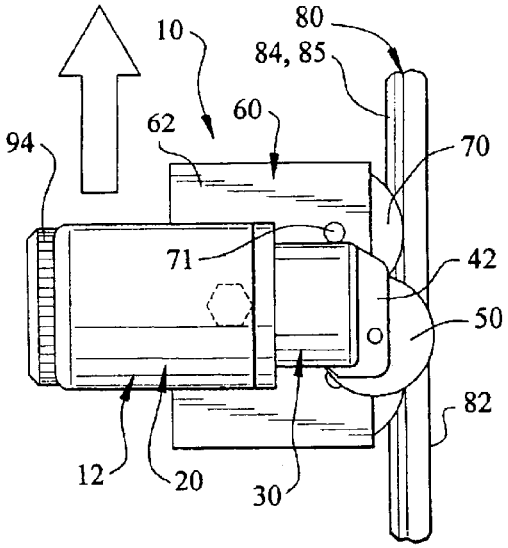
FIG. 2 is a top plan view of the device.
Figure 3:
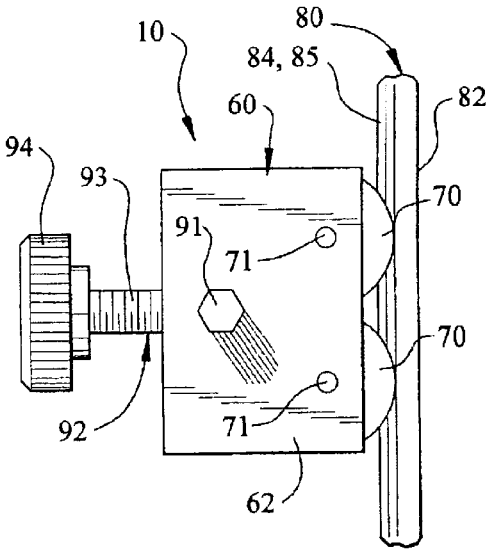
FIG. 3 is an isolated top plan view of a traveler and flexible magnetic guide track of the device.

Referring to the several figures of the drawings, the pinstripe painting device of the present invention is shown and is generally indicated as 10.

The pinstripe painting device 10 includes a paint applicator unit 12 which consists of a low profile paint container 20, an adapter 31 and a head 30. The paint container 20 includes a cylindrical side wall 22, a bottom 23, an open top 24, and an interior chamber 26 for holding a charge of paint.

The adaptor 31 of the paint applicator unit 12 includes a proximal portion 32 and a distal portion 33. The adaptor 31 enables attachment of the head 30 to the container 20. In particular, the adaptor 31 is structured and disposed to permit attachment of a BEUGLER head, such as that disclosed in U.S. Pat. No. 1,988,710, as well as other BEUGLER heads, to the low profile paint container 20 of the present invention An enlarged annular shoulder 36 separates the proximal portion and the distal portion and provides a stop limit when inserting the adaptor 31 into the open top end 24 of the container 20. The annular shoulder 36 also provides a stop limit when attaching the head 30 to the distal portion 33 of the adaptor 31. More specifically, a collar 38, defining the proximal portion 32, includes an exterior dimension which is sized and configured for snug, sliding receipt within the open end of the container. An O-ring seal 39 on the collar 38 provides a liquid tight seal between the collar and the inner cylindrical surface of the side wall of the container 20 so that the charge of paint within the interior chamber 26 does not leak from the joined engagement of the proximal portion 32 and the container 20. The proximal end 40 of the adapter 31 is open to be in fluid communication with the interior chamber 26 of the container 20, thereby allowing the charge of paint within the interior chamber 26 to flow freely into the interior of the head 30 and towards a striping wheel 50. Similarly, the distal portion 33 of the adaptor is sized for snug fitted receipt within a collar 34 of the head 30 to permit attachment thereto.

A boss 42 on the head 30 includes opposing members 44 spaced from one another to define a slot 46 therebetween. The slot 46 communicates with the interior of the head 30 and is in fluid communication with the interior chamber 26 and charge of paint contained therein. A striping wheel 50 is rotatably supported within the slot, between the opposing members 44, and is provided with an outer annular contact surface 52 of a predetermined width for applying a stripe of paint to a surface being pinstriped, such as the exterior surface of an automobile body. The outer annular contact surface 52 of the striping wheel may be knurled for carrying paint thereon as the striping wheel rotates and the outer annular contact surface 52 is exposed to the charge of paint within the applicator unit 12. Specifically, as the outer annular contact surface 52 of the striping wheel 50 is exposed to the charge of paint within the interior chamber 26 of the applicator unit 12, the paint is carried on the annular contact surface 52 by viscosity action. In operation, as the outer annular contact surface is rolled in contact with the surface being pinstriped, the paint carried on the outer annular surface is released onto the work surface being pinstriped, thereby producing a painted stripe of predetermined width which is the same width as the annular contact surface of the striping wheel. The slot 46 is structured and disposed to provide a liquid tight seal on the sides of the striping wheel 50 to prevent paint leakage.

The device 10 uses a traveler 60 and guide track 80 to direct the striping wheel 50 along a predetermined path on the surface 100 being pinstriped. The traveler 60 includes a main body 62 with a bifurcated end 64 defining parallel plate members 65, 66. The plate members 65, 66 are spaced apart to accommodate a pair of rollers 70 therebetween. The rollers 70 are each rotatable about an axle pin 71 and include spaced flanges 72 on opposite sides of a concave annular recessed surface 74.

The guide track 80 is formed of a flexible magnetic material, such as a rubber or rubber-like material, and is impregnated with magnetized particles, or otherwise magnetized, to allow the guide track to readily adhere to any ferrous metallic surface 100 without scratching the surface. The flexible magnetic guide track is easily applied to the surface 100 and can be easily positioned and shaped according to the desired path of the painted stripe to be subsequently applied to the surface 100. After use, the flexible magnetic guide track 80 is easily removed from the surface 100. The guide track 80 includes a flat back surface 82 which is specifically adapted for mating engagement with the metallic surface 100. The opposite front face 83 is provided with parallel rails 84, 85 extending longitudinally along the respective top and bottom edges of the guide track 80. The rails 84, 85 protrude outwardly from the front exposed face 83 and are provided with a rounded exterior surface for congruent, mating engagement with the annular recessed concave surface 74 of the rollers 70, thereby allowing the rollers 70 on the traveler 60 to travel along the respective rail 84 or 85 while also permitting the rollers 70 to move laterally about the rounded exterior surfaces of either of the respective rails 84, 85 so that the traveler 60 can be rocked from side-to-side, as necessary while maintaining the annular surface 52 of the striping wheel 50 in flat, uniform contact with the surface 100.

The paint applicator unit 12 is adjustably coupled to the traveler 60 to permit adjustable positioning of the paint applicator unit 12, and particularly the striping wheel 50 relative to the guide track 80 and the work surface 100. In particular, a connecting arm 90 extends from the paint applicator unit 12 and into adjustable attachment with the traveler 60. In a preferred embodiment, the connecting arm 90 has a multi-sided exterior surface, such as a hex (i.e. 6-sided) configuration and is sized for keyed receipt within an identically shaped opening 91 formed through the main body 62 of the traveler 60. This keyed arrangement between the connecting arm 90 and the opening 91 of the traveler body 62 prevents rotation of the connecting arm relative to the traveler. Sliding movement of the connecting arm 90 through the opening 91 of the traveler main body 62 permits adjustment of the distance between the paint applicator unit 12 and the traveler 60. More specifically, the sliding movement of the connecting arm 90 permits the distance between the striping wheel 50 and the rollers 70, and more particularly the guide track 80, to be adjusted. A set screw 92 includes a threaded shaft 93 which is adapted to be threadably advanced through the main body 62, perpendicular to the axis of the opening 91. A knob 94 on the end of the set screw 92 provides for ease of manipulation of the set screw in order to tighten and loosen the set screw 92 against the connecting arm 90. Once the connecting arm 90 is adjusted to the desired position, so that the striping wheel 50 is spaced from the rollers 70 of the traveler 60 at the desired distance, the set screw 92 is threadably advanced and tightened against the connecting arm 90 within the opening 91 to fix the connecting arm 90 and attached paint applicator unit 12 in position relative to the traveler 60.

The end of the connecting arm 90 is pivotally attached to a tab 95 extending from the side wall of the container 20 of the paint applicator unit 12. A screw 96 secures the connecting arm 90 to the tab 95. The pivotal attachment of the connecting arm 90 to the tab 95, using the screw 96, allows angled adjustment of the container and striping wheel 50 relative to the connecting arm 90 and traveler 60 in order to accommodate for a variation in the angle and contour of the surface 100, particularly between the area where the stripe is painted and the area where the guide track is placed on the surface 100, thereby assuring that the outer annular contact surface 52 of the striping wheel 50 is maintained in flat contact with the work surface 100 being pinstriped.

Figure 4:
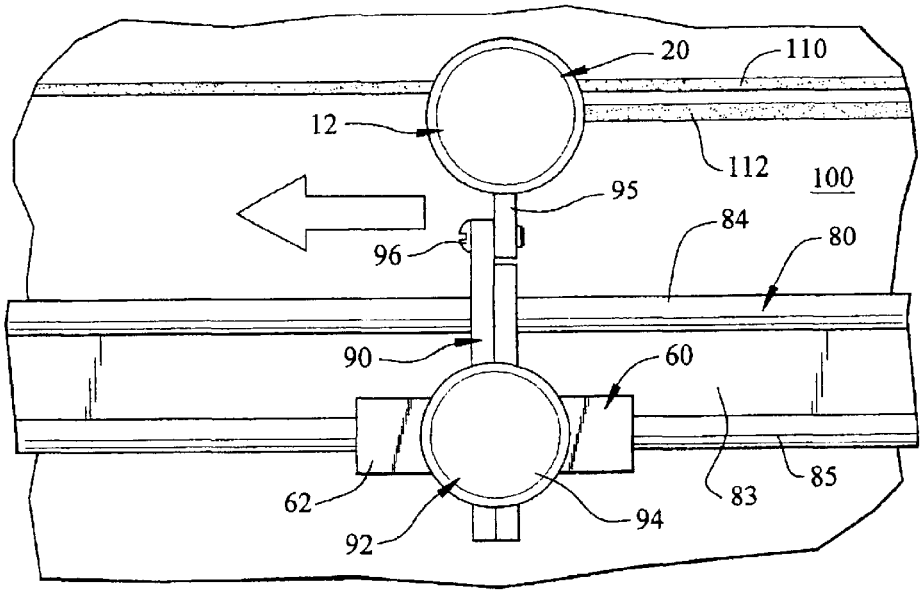
FIG. 4 is a front elevational view of the pinstripe painting device shown in use and applying a parallel pinstripe on a surface.
Figure 5A:
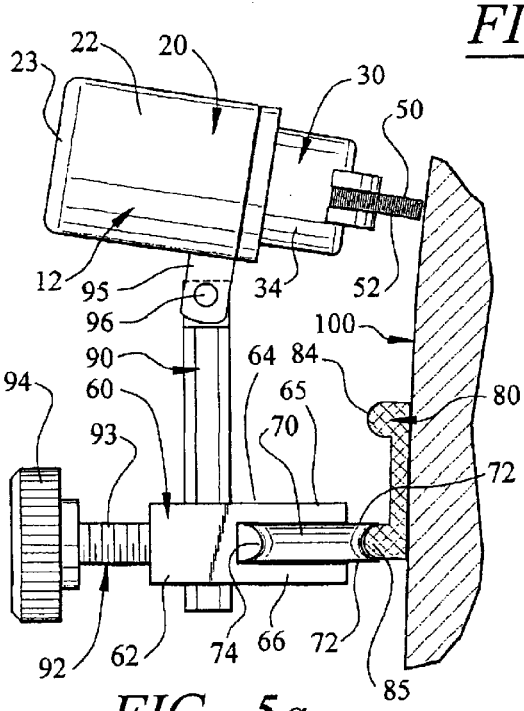
FIG. 5*a* is a side elevational view of the pinstripe painting device, in partial section, illustrating application of a painted stripe to a surface.
Figure 5B:
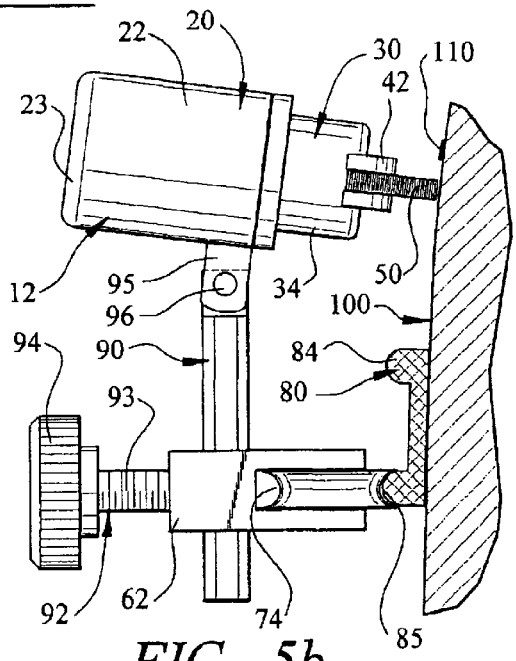
FIG. 5*b* is a side elevational view, in partial section, of the pinstripe painting device, shown applying a parallel stripe to the surface, wherein the distance between the striping wheel on the paint applicator and the guide track has been adjusted relative to the position shown in FIG. 5*a*, thereby enabling subsequent application of a pinstripe which is perfectly parallel to the painted pinstripe applied in FIG. 5*a*, without having to remove and/or reposition the flexible magnetic guide track on the surface.
Figure 6:
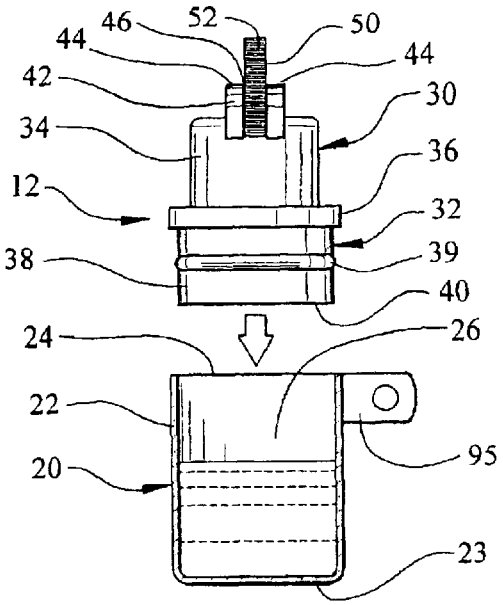
FIG. 6 is a partially exploded view, in partial cross-section, showing the assembly of the paint applicator including a head and a container.
Figure 7:
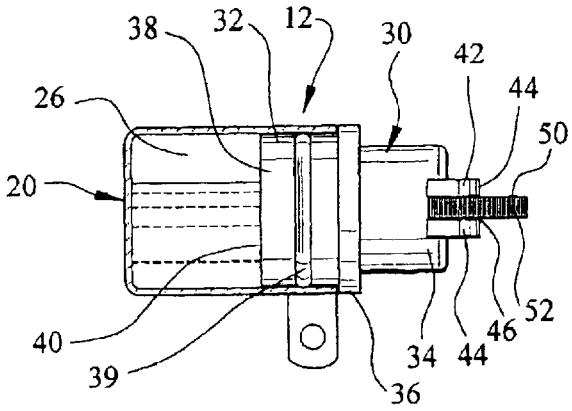
FIG. 7 is a side elevational view, in partial section, illustrating the assembled paint applicator.
Figure 8A:
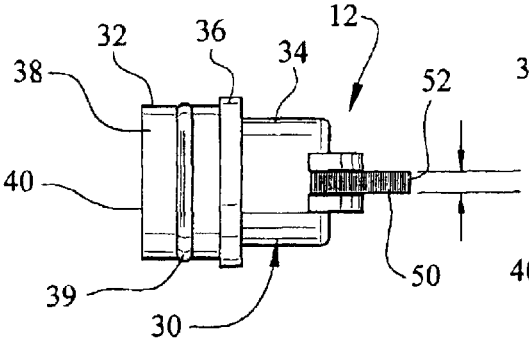
FIG. 8*a* is an isolated elevational view of the head of the paint applicator illustrating the width of a stripe applied in accordance with the width size of the striping wheel.
Figure 8B:
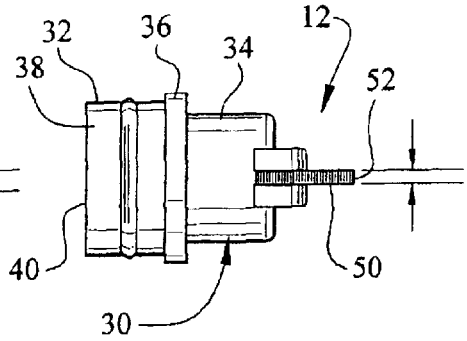
FIG. 8*b* is an isolated side elevational view illustrating a separate head of the paint applicator for applying a thinner painted stripe in accordance with the size of the striping wheel.
Figure 9:
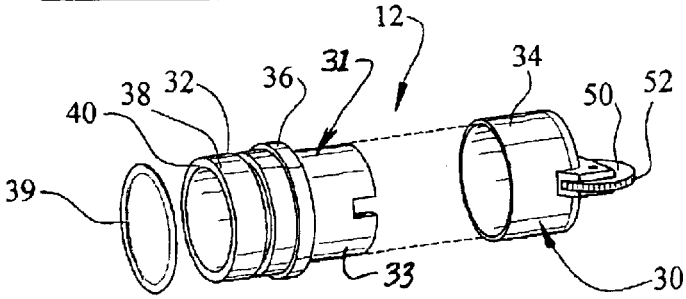
FIG. 9 is an exploded perspective view showing assembly of the adaptor and head.

Adjustable positioning of the paint applicator unit 12 relative to the traveler 60 is particularly useful when applying multiple parallel painted stripes to the surface 100. As illustrated in FIGS. 4–5*b*, the pinstripe painting device 10 is adapted for application of parallel painted stripes with the simple adjustment of the connecting arm 90, and without the need to remove and reposition the guide track 80 on the surface 100. For example, in FIG. 5*a* a first stripe of a desired width is being applied to the surface 100 as the rollers 70 of the traveler 60 travel along the bottom rail 85 of the guide track. This results in application of painted pinstripe 110 on the surface 100, as seen in FIG. 4. Next, a parallel painted pinstripe 112, which may be of the same or a different width than pinstripe 110, is applied to the surface 100. If it is desired to apply a pinstripe of a different width, then the head 30 shown in FIG. 5*a* is removed and a new head having a different striping wheel width is replaced on the applicator unit 12. Then, by loosening the set screw 92, the connecting arm 90 can be slidably adjusted to change the distance between the rollers 70 and the striping wheel 50. Then, by moving the rollers 70 along the same lower rail 85 of the guide track, the striping wheel 50 applies the second, parallel pinstripe 112 to the surface 100, as seen in FIGS. 4 and 5*b*. By maintaining the guide track in place for both application of the first pinstripe 110 and subsequent pinstripe 112, the user is assured that the subsequently applied pinstripe 112 will be equally spaced and perfectly parallel to the first painted pinstripe 112 along the entire length.

FIGS. 5*a* and 5*b* further demonstrate the usefulness of the pivotal attachment between the connecting arm 90 and the paint applicator unit 12. Specifically, it is seen that the area of the surface 100 where the pinstripes 110, 112 are applied is angled relative to the area of surface 100 where the guide track 80 is attached. Pivotal attachment, at the screw 96 and tab 95, allows the paint applicator unit 12 to be angled inwardly towards the surface 100, as seen in FIGS. 5*a* and 5*b*, so that the outer annular contact surface 52 of the striping wheel 50 is maintained in flat, direct and uniform contact with the surface 100 while the rollers 70 remain on the rail 85 of the guide track 80. The rounded congruent configuration of the rails and the surface of the rollers further allows the entire assembly of the traveler 60 and paint applicator unit 12 to be rocked relative to the guide track 80 so that the striping wheel 50 can be maintained in contact with the surface 100 throughout the length of the applied pinstripe as the angle and contour of the surface 100 changes along the length of the stripe being painted.

While the invention has been shown and described in accordance with a preferred and practical embodiment thereof, it is recognized that departures from the instant disclosure are contemplated within the spirit and scope of the present invention and, therefore, should not be limited except as set forth in the following claims as interpreted under the doctrine of equivalents.

What is claimed is:

1. A painting device for applying a painted pinstripe to a surface, said device comprising:

a paint applicator including:

a container having an open end and an interior chamber for holding a charge of paint;

a head provided with a slot which communicates with said interior chamber of said container and a striping wheel having an outer annular surface, and said striping wheel rotatably mounted in said slot so that a segment of said outer annular surface protrudes from said slot, and said slot and said striping wheel being arranged so that the outer annular surface enters said head, in communication with said interior chamber of said container, and said striping wheel being structured and disposed to carry the paint on said outer annular surface upon rotation thereof and exposure of said outer annular surface to said charge of paint within said interior chamber; and an adaptor for attaching said head to said open end of said container, and said adaptor including a distal portion structured and disposed for liquid-tight attachment to said head, and a proximal portion structured and disposed for liquid-tight attachment to said open end of said container so that said slot and a segment of said striping wheel entering said head through said slot are disposed in liquid communication with said interior chamber and the charge of paint contained therein;

a magnetized flexible guide track having a back surface structured and disposed for mating, releasable attachment to a mounting surface and at least one rail protruding from an opposite front face of said guide track and extending longitudinally therealong, said rail having a rounded exterior surface;

a traveler having at least one roller rotatably supported thereon, said al least one roller including a concave annular recessed surface for congruent, mating engagement with said rounded exterior surface of said rail on said guide track for guiding rolling movement of said traveler along said rail of said guide track;

a connecting arm for adjustably coupling said paint applicator to said traveler, said connecting arm being adjustably attachable to said traveler at a first end portion and said connecting arm being pivotally attached to said paint applicator at an opposite second end portion, and said pivotal attachment of said connecting arm to said paint applicator being structured and disposed to permit pivotal adjustment of said paint applicator throughout a range of selectively adjusted, fixed positions relative to said connecting arm and said traveler, and said connection of said first end portion of said connecting arm to said traveler being structured and disposed to permit selective adjustment of the distance between said striping wheel and said at least one roller of said traveler throughout a range of selectively adjusted fixed positions.

* * * * *